US009047849B2

(12) United States Patent
Koster

(10) Patent No.: US 9,047,849 B2
(45) Date of Patent: Jun. 2, 2015

(54) PICK HOLDER

(71) Applicant: Hogjim LLC, Laramie, WY (US)

(72) Inventor: Kyle Koster, Laramie, CO (US)

(73) Assignee: Hogjim LLC, Laramie, WY (US)

( * ) Notice: Subject to any disclaimer, the term of this patent is extended or adjusted under 35 U.S.C. 154(b) by 0 days.

(21) Appl. No.: 14/259,977

(22) Filed: Apr. 23, 2014

(65) Prior Publication Data

US 2014/0311318 A1 Oct. 23, 2014

Related U.S. Application Data

(63) Continuation of application No. 29/452,951, filed on Apr. 23, 2013, now Pat. No. Des. 712,454.

(51) Int. Cl.
*G10D 3/16* (2006.01)
*G10D 1/08* (2006.01)

(52) U.S. Cl.
CPC ..... *G10D 3/163* (2013.01); *Y10T 29/49826* (2015.01); *G10D 1/08* (2013.01)

(58) Field of Classification Search
CPC ..... G10D 3/163
USPC ..... 84/320–322
See application file for complete search history.

(56) References Cited

U.S. PATENT DOCUMENTS

| | | | | |
|---|---|---|---|---|
| 5,488,892 | A | 2/1996 | Jepsen | |
| 5,649,634 | A * | 7/1997 | Irizarry | 211/120 |
| 5,796,021 | A * | 8/1998 | Longshore | 84/329 |
| 6,215,052 | B1 * | 4/2001 | Giddens et al. | 84/329 |
| 6,639,136 | B1 | 10/2003 | Judd | |
| 6,933,430 | B2 | 8/2005 | Oskorep | |

OTHER PUBLICATIONS

United States Design U.S. Appl. No. 29/452,951, filed Apr. 23, 2013.

* cited by examiner

*Primary Examiner* — Kimberly Lockett
(74) *Attorney, Agent, or Firm* — Craig R. Miles; CR Miles P.C.

(57) ABSTRACT

Generally, a body having body upper face, a closed-end aperture element disposed in the body communicating with the body upper face, and a securement element affixed to the body opposite the body upper face, which can removably couple to a support surface. Specifically, a pick holder having body upper face, a closed-end aperture element disposed in the body communicating with the body upper face, which can be configured to removably retain a pick, and a suction cup affixed to the body opposite the body upper face, which can removably couple to a stringed instrument.

20 Claims, 5 Drawing Sheets

5
15
17
16
52
19
18
25
28/41A
27/41A
42
43
44
23
22/41
24
26

22/41
11
14
13
15
9
10
5
1
47/48

5
8
22/41
6
12
7
1
47/48

PICK HOLDER

This United States Non-Provisional Patent Application is a continuation of U.S. Design patent application Ser. No. 29/452,951, filed Apr. 23, 2013, hereby incorporated by reference herein.

I. FIELD OF THE INVENTION

Generally, a body having body upper face, a closed-end aperture element disposed in the body communicating with the body upper face, and a securement element affixed to the body opposite the body upper face, which can removably couple to a support surface. Specifically, a pick holder having body upper face, a closed-end aperture element disposed in the body communicating with the body upper face, which can be configured to removably retain a pick, and a suction cup affixed to the body opposite the body upper face, which can removably couple to a stringed instrument.

II. BACKGROUND OF THE INVENTION

A stringed instrument may be played with a pick, which may be used to strike or pluck the strings of the stringed instrument. Picks may be relatively small and consequently, may be easily misplaced or lost. Accordingly, a challenge for stringed instrument users may be to keep a pick readily available for use.

Conventional devices may exist which can releasably couple a pick with a stringed instrument. However, these pick couplers may be too complex or too cumbersome to be used conveniently. Additionally, coupling a pick coupler to a stringed instrument may require physical alteration of the instrument to accommodate installation of the pick coupler thereonto or may require the use of an adhesive to affix the pick coupler to the body of the stringed instrument, both of which may be undesirable to a user. Furthermore, the appearance of a stringed instrument as well as a device coupled to the stringed instrument may be important to a user; thus, it may be preferable to couple a pick coupler to a stringed instrument which does not detract from the appearance of the stringed instrument.

III. SUMMARY OF THE INVENTION

A broad object of a particular embodiment of the invention can be to provide a pick holder including a body having a body upper face, a closed-end arcuate aperture element disposed in the body communicating with the body upper face, and a securement element affixed to the body opposite the body upper face.

Another broad object of a particular embodiment of the invention can be to provide a pick holder a body having a body upper face, a body upper face periphery bounding the body upper face, a closed-end elongate aperture element disposed in the body communicating with the body upper face, a suction cup affixed to the body opposite the body upper face, and a suction cup periphery bounding the suction cup, the body upper face periphery and the suction cup periphery contoured to extend in generally adjacent parallel relation.

Another broad object of a particular embodiment of the invention can be to provide a method of producing a pick holder including providing a body having a body upper face, disposing a closed-end arcuate aperture element in the body communicating with the body upper face, and affixing a securement element to the body opposite the body upper face.

Another broad object of a particular embodiment of the invention can be to provide a method of producing a pick holder including providing a body having a body upper face, disposing a closed-end elongate aperture element in the body communicating with the body upper face, bounding the body upper face with a body upper face periphery, affixing a suction cup to the body opposite the body upper face, bounding the suction cup with a suction cup periphery, and contouring the body upper face periphery and the suction cup periphery to extend in generally adjacent parallel relation.

Another broad object of a particular embodiment of the invention can be to provide a method of using a pick holder including obtaining the pick holder including a body having a body upper face, a closed-end arcuate aperture element disposed in the body communicating with the body upper face, and a securement element affixed to the body opposite the body upper face; and securing the securement element to a support surface.

Another broad object of a particular embodiment of the invention can be to provide a method of using a pick holder including obtaining the pick holder including a body having a body upper face, a body upper face periphery bounding the body upper face, a closed-end elongate aperture element disposed in the body communicating with the body upper face, a suction cup affixed to the body opposite the body upper face, and a suction cup periphery bounding the suction cup, the body upper face periphery and the suction cup periphery contoured to extend in generally adjacent parallel relation; and securing the suction cup to a support surface.

Naturally, further objects of the invention are disclosed throughout other areas of the specification, drawings, and claims.

IV. BRIEF DESCRIPTION OF THE DRAWINGS

V. DETAILED DESCRIPTION OF THE INVENTION

Figure 1A:
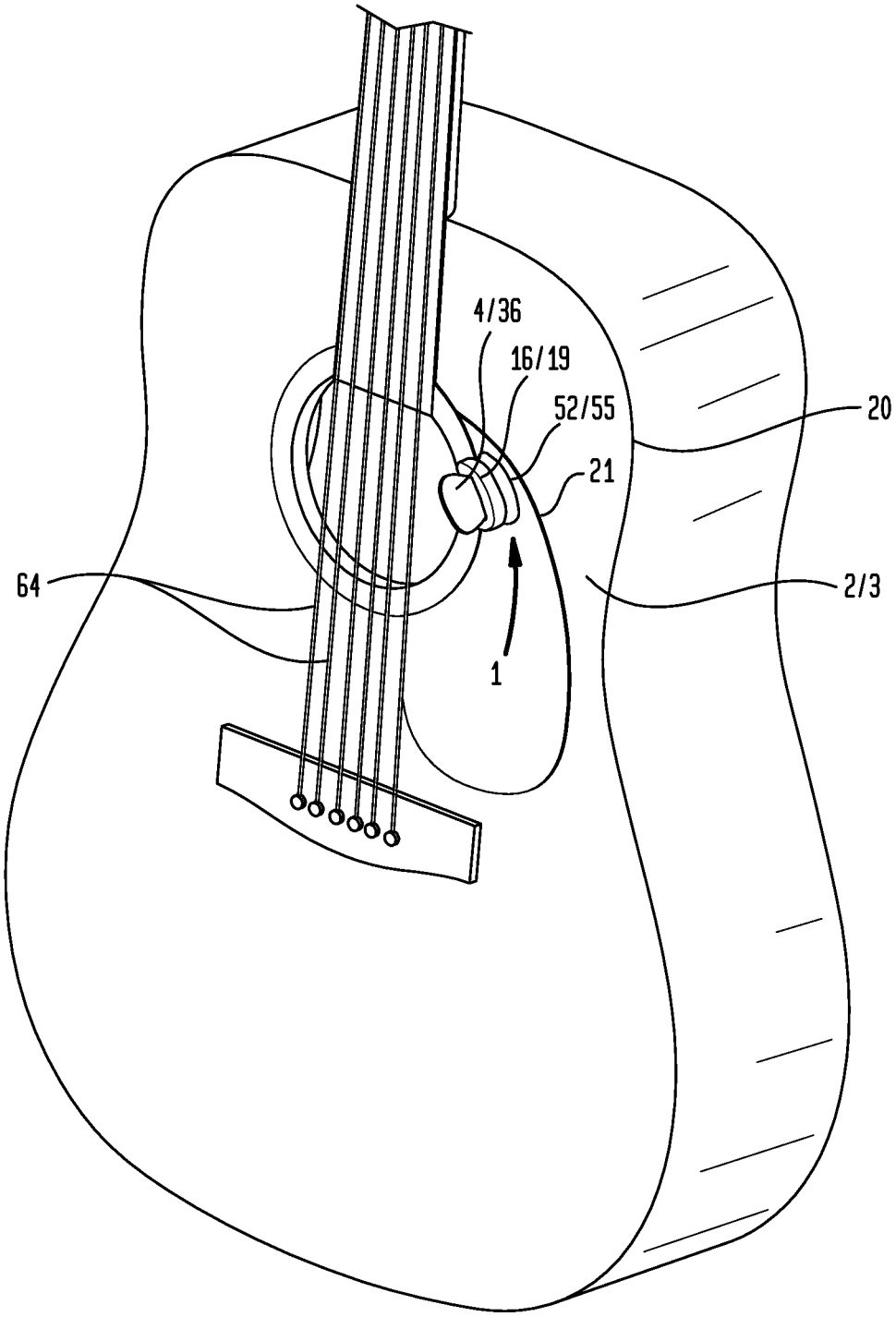
FIG. 1A is an illustration of a method of using a particular embodiment of the inventive pick holder.
Figure 1B:
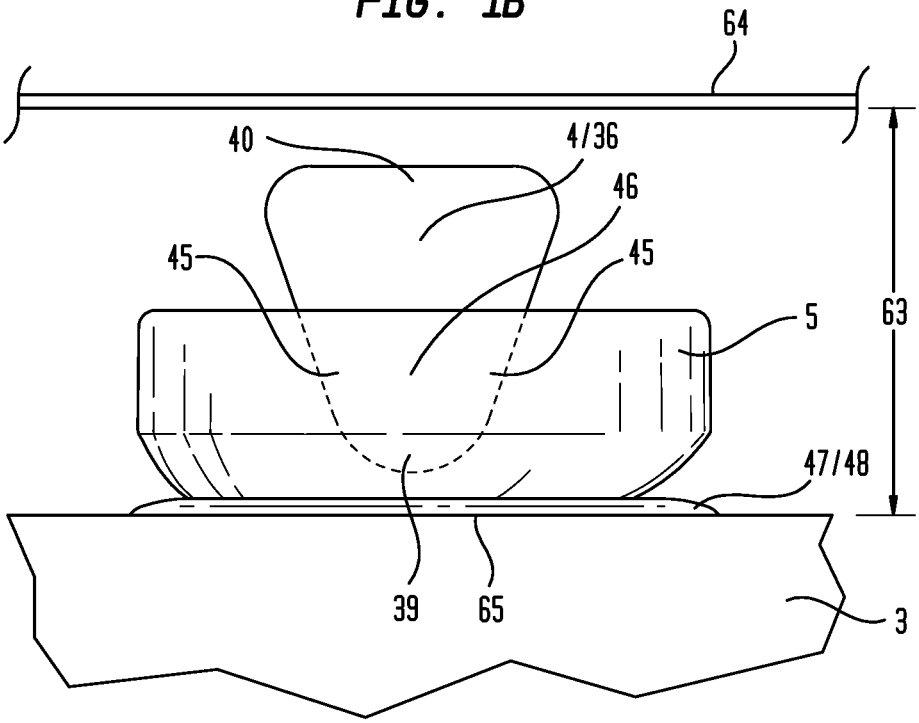
FIG. 1B is an illustration of a method of using a particular embodiment of the inventive pick holder.

Now referring primarily to FIG. 1A and FIG. 1B, which illustrate a method of using a particular embodiment of the inventive pick holder (1). A user can obtain an inventive pick holder (1) and removably couple the inventive pick holder (1)

to a support surface (2), for example a stringed instrument (3). As to particular embodiments, a user can insert a pick (4) into the inventive pick holder (1) removably coupled to the stringed instrument (3), whereby the pick (4) can be releasably retained by the inventive pick holder (1). Additionally, the user can remove the pick (4) from the inventive pick holder (1) for use of the pick (4).

Figure 2:
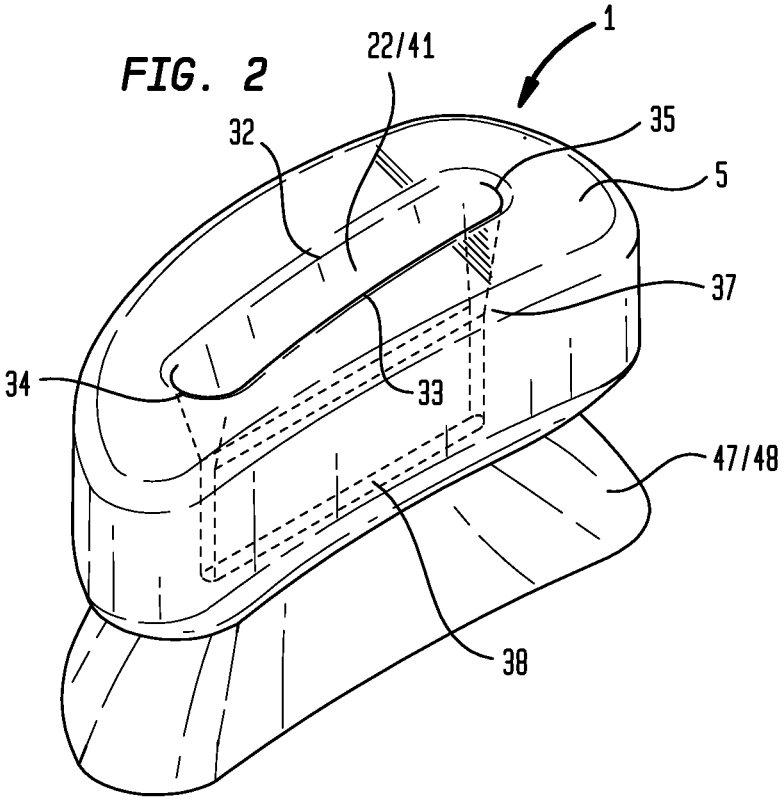
FIG. 2 is a perspective view of a particular embodiment of the inventive pick holder.
Figures 3, 4, 5:
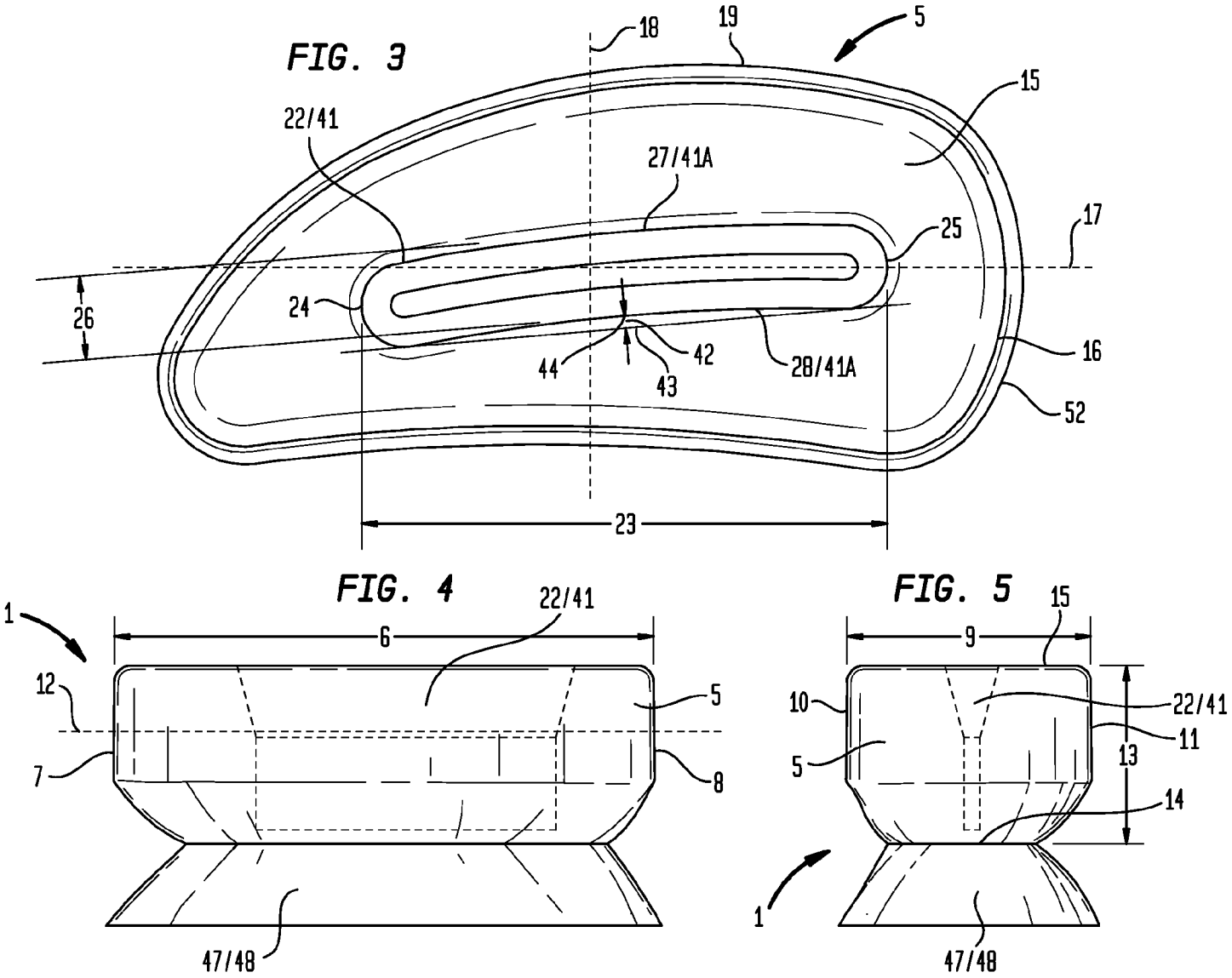
FIG. 3 is a top view of a particular embodiment of the inventive pick holder.
FIG. 4 is a first side view of a particular embodiment of the inventive pick holder.
FIG. 5 is a first end view of a particular embodiment of the inventive pick holder.

Now referring primarily to FIG. 2 through FIG. 4, the inventive pick holder (1) can include a body (5) having a body length (6) disposed between a body first end (7) and a body second end (8). Typically, the body length (6) can be in a range of between about 5 millimeters to about 50 millimeters; however, embodiments can have a lesser or greater body length (6) depending upon the application.

Now referring primarily to FIG. 5, the inventive pick holder (1) can include a body (5) having a body width (9) disposed between a body first side (10) and a body second side (11). Typically, the body width (9) can be in a range of between about 5 millimeters to about 50 millimeters; however, embodiments can have a lesser or greater body width (9) depending upon the application.

As to particular embodiments, the body length (6) and the body width (9) can be substantially similar. As to other particular embodiments, the body length (6) can be lesser than the body width (9). As to other particular embodiments, the body length (6) can be greater than the body width (9); as such, the body (5) can comprise an elongate body (5) having an elongate body longitudinal axis (12) (as shown in the example of FIG. 4) along the elongate body length (6).

As to particular embodiments, the body length (6) can be uniform across the body width (9). As to other particular embodiments, the body length (6) can vary along the body width (9). Similarly, as to particular embodiments, the body width (9) can be uniform along the body length (6). As to other particular embodiments, the body width (9) can vary along the body length (6).

Again referring primarily to FIG. 5, the inventive pick holder (1) can include a body (5) having a body height (13) disposed between a body lower face (14) and a body upper face (15). Typically, the body height (13) can be in a range of between about 5 millimeters to about 20 millimeters; however, embodiments can have a lesser or greater body height (13) depending upon the application.

As to particular embodiments, the body length (6) can be uniform over the body height (13). As to other particular embodiments, the body length (6) can vary over the body height (13). Similarly, the body width (9) can be uniform over the body height (6). As to other particular embodiments, the body width (9) can vary over the body height (6). As an illustrative example, a body (5) can have a body length (6) of about 33 millimeters, a body width (9) of about 14 millimeters, and a body height (13) of about 10 millimeters.

Now referring primarily to FIG. 3, the body (5) can have a body upper face (15) bounded by a body upper face periphery (16), which can define numerous configurations of varying dimensions depending upon the application. As to particular embodiments, the body upper face periphery (16) can define a symmetrical configuration, including or consisting of a circle, an oval, a triangle, a square, a rectangle, a trapezoid, a polygon, or the like, or combinations thereof. As to other particular embodiments, the body upper face periphery (16) can define an asymmetrical configuration, a freeform configuration, or the like, or combinations thereof. As to particular embodiments, the body upper face periphery (16) can be substantially symmetrical or asymmetrical about a body upper face longitudinal axis (17) or about a body upper face latitudinal axis (18) (as shown in the example of FIG. 3).

Now referring primarily to FIG. 3, the body upper face periphery (16) can include a body upper face periphery portion (19) contoured to extend in generally adjacent parallel relation to the contour of a support surface (2) periphery portion, such as a stringed instrument body periphery portion (20) (as shown in the example of FIG. 1A). As to other particular embodiments, a body upper face periphery portion (19) can be contoured to extend in generally adjacent parallel relation to a pickguard periphery portion (21) (as shown in the example of FIG. 1A).

Now referring primarily to FIG. 3, as to particular embodiments, the body upper face (15) bounded by the body upper face periphery (16) can be substantially planar, arcuate, undulating, or combinations thereof.

Now referring primarily to FIG. 2 through FIG. 8, the inventive pick holder (1) can include a closed-end elongate aperture element (22) disposed in the body (5) communicating with the body upper face (15). The closed-end elongate aperture element (22) can include an aperture element length (23) (as shown in the example of FIG. 3) disposed between an aperture element first end (24) and an aperture element second end (25). Typically, the aperture element length (23) can be in a range of between about 5 millimeters to about 50 millimeters; however, embodiments can have a lesser or greater aperture element length (23) depending upon the application.

Now referring primarily to FIG. 2 through FIG. 8, the closed-end elongate aperture element (22) can include an aperture element width (26) (as shown in the example of FIG. 3) disposed between an aperture element first side (27) and an aperture element second side (28). Typically, the aperture element width (26) can be in a range of between about 0.1 millimeters to about 10 millimeters; however, embodiments can have a lesser or greater aperture element width (26) depending upon the application. The aperture element width (26) can be selected from the group including or consisting of: between about 0.1 millimeters to about 2 millimeters; between about 1 millimeter to about 3 millimeters; between about 2 millimeters to about 4 millimeters; between about 3 millimeters to about 5 millimeters; between about 4 millimeters to about 6 millimeters; between about 5 millimeters to about 7 millimeters; between about 6 millimeters to about 8 millimeters; between about 7 millimeters to about 9 millimeters; and between about 8 millimeters to about 10 millimeters.

As to particular embodiments, the aperture element length (23) can be uniform across the aperture element width (26). As to other particular embodiments, the aperture element length (23) can vary across the aperture element width (26). Similarly, as to particular embodiments, the aperture element width (26) can be uniform along the aperture element length (23). As to other particular embodiments, the aperture element width (26) can vary along the aperture element length (23). As an illustrative example, a closed-end elongate aperture element (22) can have an aperture element length (23) of about 20 millimeters and an aperture element width (26) of about 0.75 millimeters.

Figure 7:
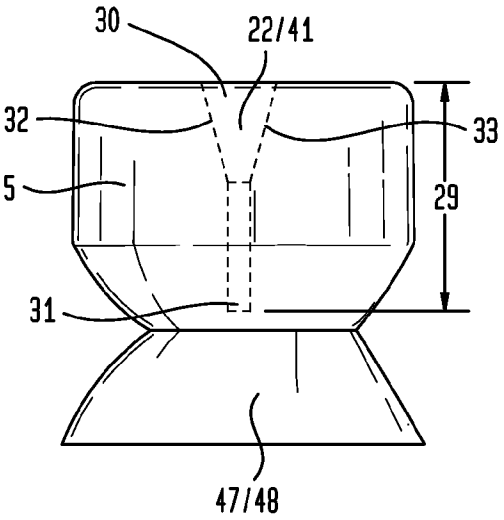
FIG. 7 is a second end view of a particular embodiment of the inventive pick holder.

Now referring primarily to FIG. 7, the closed-end elongate aperture element (22) can include an aperture element height (29) disposed between an aperture element upper portion (30) and an aperture element lower portion (31). Typically, the aperture element height (29) can be in a range of between about 1 millimeter to about 50 millimeters; however, embodiments can have a lesser or greater aperture element height (29) depending upon the application.

As to particular embodiments, the aperture element length (23) can be uniform along the aperture element height (29).

As to other particular embodiments, the aperture element length (23) can vary along the aperture element height (29).

As to particular embodiments, the aperture element width (26) can be uniform along the aperture element height (29). As an illustrative example, a closed-end elongate aperture element (22) can have an aperture element width (26) of about 0.5 millimeters along the entirety of the aperture element height (29).

As to other particular embodiments, the aperture element width (26) can vary along the aperture element height (29). As an illustrative example, a closed-end elongate aperture element (22) can have an aperture element width (26) of about 0.5 millimeters along the aperture element lower portion (31) and an aperture element width (26) of about 3 millimeters along the aperture element upper portion (30).

Figure 6:
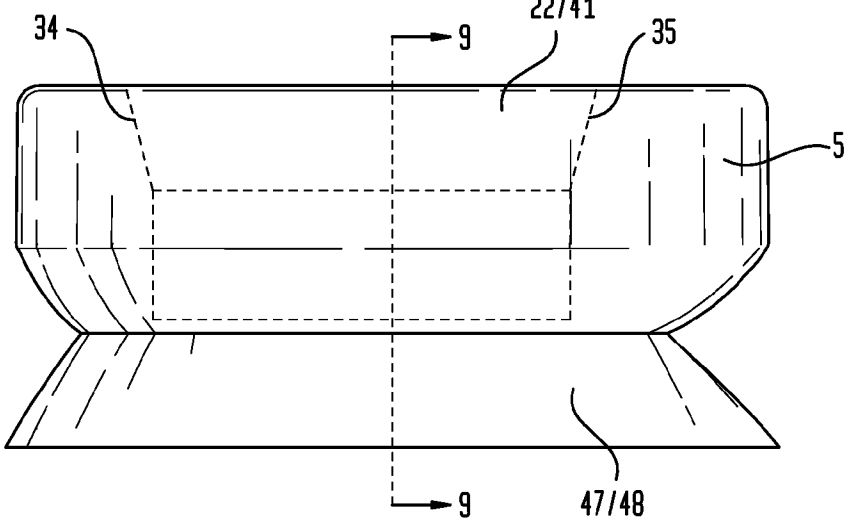
FIG. 6 is a second side view of a particular embodiment of the inventive pick holder.

Now referring primarily to FIG. 6 and FIG. 7, the closed-end elongate aperture element (22) can include a pair of opposed aperture element sides (32)(33) disposed in opposed relation between a pair of opposed aperture element ends (34)(35); as such, the closed-end elongate aperture element (22) can be configured to releasably retain an object (36) insertingly received by the aperture element upper portion (30). As to other particular embodiments, the closed-end elongate aperture element (22) can include a pair of opposed aperture element sides (32)(33); as such, the closed-end elongate aperture element (22) can be configured to releasably retain an object (36) insertingly received by the aperture element upper portion (30) or one of the pair of opposed aperture element ends (34)(35).

As to particular embodiments, a portion of the body (5) bounding the closed-end elongate aperture element (22) can be configured to apply forces to an object (36) of planate configuration insertingly received within the closed-end elongate aperture element (22). As to particular embodiments, the forces can be frictional forces applied along a pair of opposed aperture element sides (32)(33), along a pair of opposed aperture element ends (34)(35), or combinations thereof. The forces can be suitable to releasably retain the object (36) having a planate configuration within the closed-end elongate aperture element (22).

Figure 9:
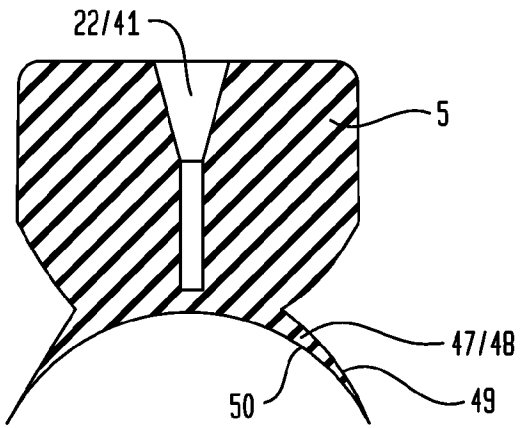
FIG. 9 is a cross sectional view 9-9 of the particular embodiment of the inventive pick holder shown in FIG. 6.

Now referring primarily to FIG. 2 and FIG. 9, as to particular embodiments, the aperture element width (26) of the aperture element upper portion (30) can be greater at the body upper face (15) with the opposed aperture element sides (32)(33) tapering inwardly to provide a lesser aperture element width (26) approaching an aperture element medial portion (37). As to particular embodiments, the opposed aperture element sides (32)(33) can be disposed in substantially parallel opposed relation from about the aperture element medial portion (37) to the closed end (38) of the aperture element lower portion (31) to maintain a uniform lesser aperture element width (26). The portion of the body (5) bounding the aperture element lower portion (31) having the lesser aperture element width (26) can apply frictional forces which can releasably retain an object (36) of planate configuration within the closed-end elongate aperture element (22).

Again referring primarily to FIG. 2 and FIG. 9, as to particular embodiments, the aperture element length (23) of the aperture element upper portion (30) can be greater at the body upper face (15) with the opposed aperture element ends (34)(35) tapering inwardly to provide a lesser aperture element length (23) approaching an aperture element medial portion (37). As to particular embodiments, the opposed aperture element ends (34)(35) can be disposed in substantially parallel opposed relation from about the aperture element medial portion (37) to the closed end (38) of the aperture element lower portion (31) to maintain a uniform lesser aperture element length (23). The portion of the body (5) bounding the aperture element lower portion (31) having the lesser aperture element length (23) can apply frictional forces which can releasably retain an object (36) of planate configuration within the closed-end elongate aperture element (22).

As to particular embodiments, the greater aperture element length (23) or greater aperture element width (26) at the body upper face (15) can define an increased open area into which an object (36) can be removably inserted. The tapering opposed aperture element sides (32)(33) or opposed aperture element ends (34)(35) can act to guide an object (36) inserted into the closed-end elongate aperture element (22) at the body upper face (15) toward the lesser aperture element length (23) or lesser aperture element width (26) capable of retaining the object (36), even when the object (36) has a planate configuration.

As to particular embodiments, the closed-end elongate aperture element (22) can be configured to releasably retain a portion of a pick (4) having a pick thickness in a range of between about 0.44 millimeters and about 1.5 millimeters, including as examples: an extra light pick having a thickness of less than about 0.44 millimeters, a light pick (4) having a thickness of between about 0.45 millimeters and about 0.69 millimeters, a medium pick (4) having a thickness of between about 0.70 millimeters and about 0.84 millimeters, a heavy pick (4) having a thickness of between about 0.85 millimeters and about 1.2 millimeters, an extra heavy pick (4) having a thickness of greater than about 1.5 millimeters, or the like, or combinations thereof. As to particular embodiments, a portion of the body (5) can bound a closed-end elongate aperture element (22) configured to releasably retain a tip portion (39) of the pick (4), positioning the broad portion (40) of the pick (4) for grasping (as shown in the example of FIG. 1B).

Now referring primarily to FIG. 4, the closed-end elongate aperture element (22) can be disposed in the body upper face (15) aligned with the elongate body longitudinal axis (12). As to particular embodiments, the closed-end elongate aperture element (22) can be disposed lengthwise along a central elongate body longitudinal axis (12). As to other particular embodiments, the closed-end elongate aperture element (22) can be disposed lengthwise along a peripheral elongate body longitudinal axis (12). As to particular embodiments, a plurality of closed-end elongate aperture elements (22) can be disposed lengthwise along a plurality of corresponding elongate body longitudinal axes (12).

Now referring primarily to FIG. 2 and FIG. 3, the closed-end elongate aperture element (22) can be a closed-end arcuate aperture element (41). The closed-end arcuate aperture element (41) can define an arc (41A) having an arc height (42) disposed between the arc chord (43) and the arc zenith (44) (as shown in the example of FIG. 3). Typically, the arc height (42) can be in a range of between about 0.1 millimeters to about 5 millimeters; however, embodiments can have a lesser or greater arc height (42) depending upon the application.

Now referring primarily to FIG. 1B, a portion of the body (5) bounding the closed-end arcuate aperture element (41) can apply forces to an object (36) having a planate configuration insertingly received within the closed-end arcuate aperture element (41). Upon insertion of the object (36) within the closed-end arcuate aperture element (41), the object outer margins (45), can be disposed toward the pair of opposed aperture element ends (34)(35) to direct forces toward the center of the circle defined by the arc (41A), correspondingly urging the object outer margins (45) toward the center of the circle defined by the arc (41A). Concurrently, the object medial portion (46) insertingly received within the closed-end arcuate aperture element (41) can receive forces directed away from the center of the circle defined by the arc (41A), correspondingly urging the object medial portion (46) away from the center of the circle defined by the arc (41A). Accordingly, one or more of these forces can releasably retain the object (36) within the closed-end arcuate aperture element (41). Additionally, frictional forces generated by sliding engagement of the object (36) with the pair of opposed aperture element sides (32)(33), with the pair of opposed aperture element ends (34)(35), or combinations thereof, can assist to releasably retain the planar object (36) within the closed-end arcuate aperture element (41).

Now referring primarily to FIG. 4 through FIG. 9, the inventive pick holder (1) can include a securement element (47) affixed to the body (5) opposite the body upper face (15). As to particular embodiments, the securement element (47) can be a suction cup (48); however, the securement element (47) can be provided in a variety of other forms, as illustrative examples: adhesive, double-sided adhesive material, matable hook and loop materials, mechanical fasteners, or the like. The suction cup (48) can include a suction cup convex surface (49) opposite a suction cup concave surface (50) (as shown in the example of FIG. 9). As to particular embodiments, a portion of the suction cup convex surface (49) can be connected to the body lower face (14) opposite the body upper face (15).

Figure 8:
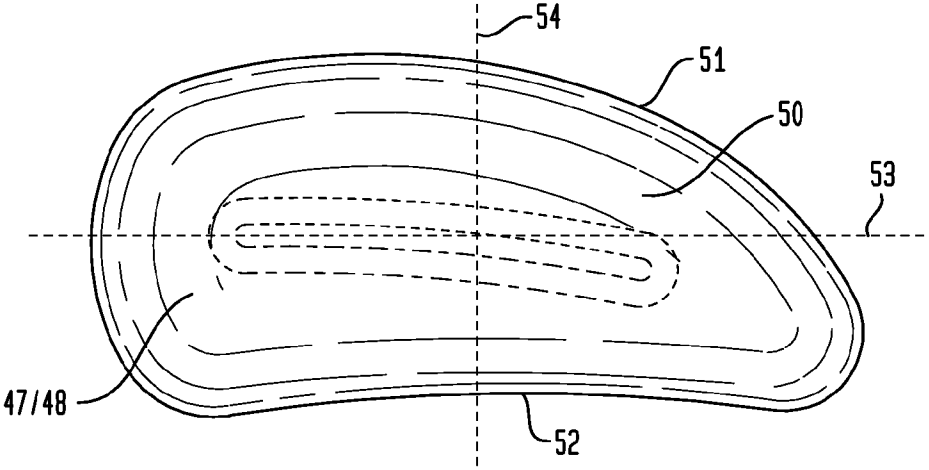
FIG. 8 is a bottom view of a particular embodiment of the inventive pick holder.

Now referring primarily to FIG. 8, the suction cup (48) can have a suction cup thickness (51) disposed between the suction cup convex surface (49) and the suction cup concave surface (50). Typically, the suction cup thickness (51) can be in a range of between about 0.1 millimeters to about 5 millimeters; however, embodiments can have a lesser or greater suction cup thickness (51) depending upon the application.

As to particular embodiments, the suction cup thickness (51) can be substantially uniform throughout the suction cup (48). As to other particular embodiments, the suction cup thickness (51) can be non-uniform throughout the suction cup (48). For example, the suction cup (48) can have a suction cup thickness (51) of a central portion of the suction cup (48) which can be greater than the suction cup thickness (51) of a peripheral portion of the suction cup (48). As another example, the suction cup (48) can have a suction cup thickness (51) of a central portion of the suction cup (48) which can be lesser than the suction cup thickness (51) of a peripheral portion of the suction cup (48).

Now referring primarily to FIG. 3 and FIG. 8, the suction cup concave surface (50) and the suction cup convex surface (49) can meet at a suction cup periphery (52), which can have any of a numerous and wide variety of configurations. As to particular embodiments, the suction cup periphery (52) can define a symmetrical configuration, including or consisting of a circle, an oval, a triangle, a square, a rectangle, a trapezoid, a polygon, or the like, or combinations thereof. As to other particular embodiments, the suction cup periphery (52) can define an asymmetrical configuration, a freeform configuration, or the like, or combinations thereof.

As to particular embodiments, the suction cup periphery (52) can be substantially symmetrical or asymmetrical about a suction cup longitudinal axis (53) or about a suction cup latitudinal axis (54) (as shown in the example of FIG. 8).

Now referring primarily to FIG. 3 and FIG. 8, the suction cup periphery (52) can include linear portions, arcuate portions, undulating portions, or combinations thereof. As to particular embodiments, the suction cup periphery (52) and the body upper face periphery (16) can be contoured to extend in generally adjacent parallel relation (as shown in the example of FIG. 1).

Now referring primarily to FIG. 1, the suction cup periphery (52) can include a suction cup periphery portion (55) contoured to extend in generally adjacent parallel relation to body upper face periphery portion (19), a stringed instrument body periphery portion (20), or a pickguard periphery portion (21).

As to particular embodiments, the suction cup periphery (52) can have dimensions substantially similar to the body upper face periphery (16). As to other particular embodiments, the suction cup periphery (52) can have lesser or greater dimensions than the body upper face periphery (16).

Figure 10A:
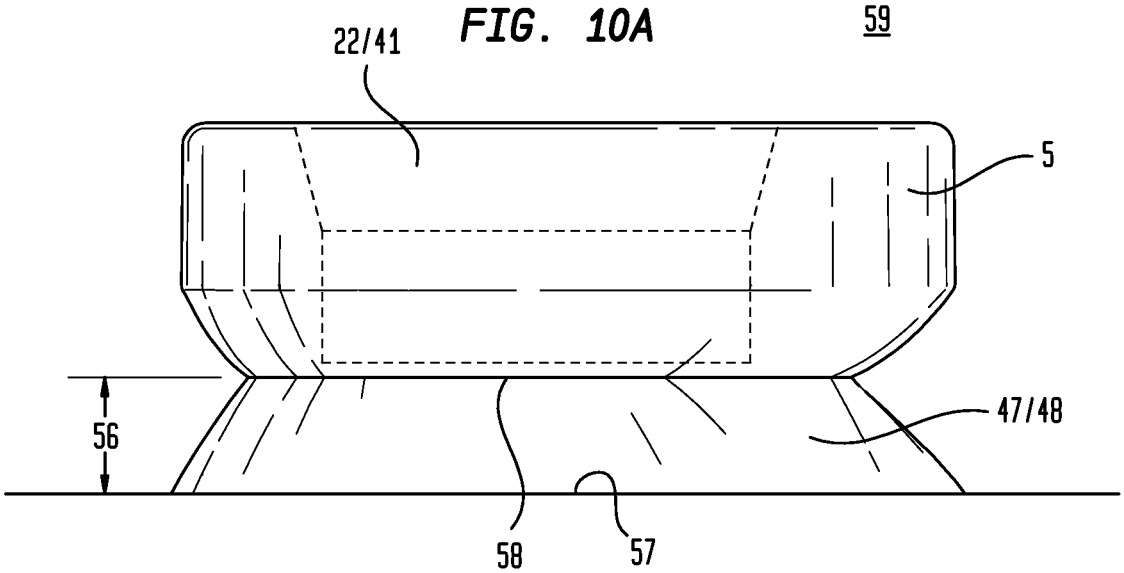
FIG. 10A is a perspective view of a particular embodiment of the inventive pick holder in a disengaged condition.

Now referring primarily to FIG. 10A, the suction cup (48) can have a suction cup height (56) disposed between a suction cup lower end (57) and a suction cup upper end (58). Typically, the suction cup height (56) can be in a range of between about 1 millimeter to about 20 millimeters; however, embodiments can have a lesser or greater suction cup height (56) depending upon the application.

Figure 10B:
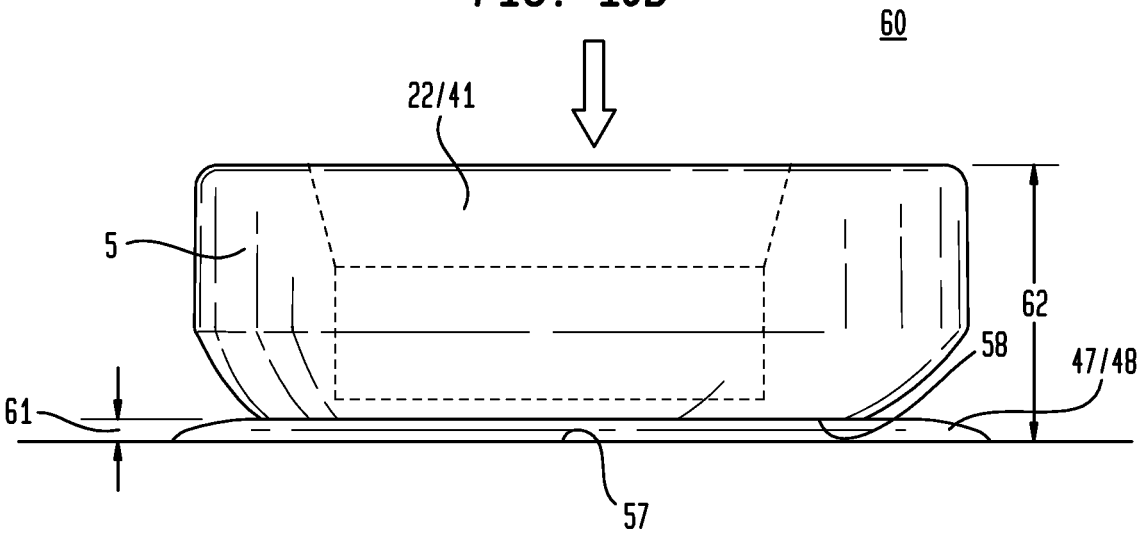
FIG. 10B is a perspective view of a particular embodiment of the inventive pick holder in an engaged condition.

Now referring primarily to FIG. 10A and FIG. 10B, the suction cup (48) can be disposed between an unsecured condition (59) in which the suction cup (48) remains unsecured or discrete from a support surface (2) (as shown in the example of FIG. 10A) and a secured condition (60) in which the suction cup (48) removably affixes or secures to a support surface (2) (as shown in the example of FIG. 10B). The suction cup (48) can be disposed in the secured condition (60) by engaging the suction cup periphery (52) with the support surface (2) and by applying pressure (as shown by the arrow in FIG. 10B) to the suction cup (48) to compress the suction cup convex surface (49) toward the support surface (2), the pressure sufficient to substantially flatten the suction cup concave surface (50) and expel the gas from between the suction cup concave surface (50) and the support surface (2), the suction cup periphery (52) thereby forming a seal with the support surface (2) to removably secure the suction cup (48) to the support surface (2).

Now referring primarily to FIG. 10B, in the secured condition (60), the suction cup (48) can have a secured suction cup height (61) disposed between a secured suction cup lower end (57) and a secured suction cup upper end (58). Typically, the secured suction cup height (61) can be in a range of between about 1 millimeter to about 20 millimeters; however, embodiments can have a lesser or greater secured suction cup height (61) depending upon the application.

Now referring primarily to FIG. 10B, the inventive pick holder (1) can include a secured pick holder height (62) which can include the body height (13) and the secured suction cup height (61). Typically, the secured pick holder height (62) can be in a range of between about 5 millimeters to about 30 millimeters; however, embodiments can have a lesser or greater secured pick holder height (62) depending upon the application. The secured pick holder height (62) can be selected from the group including or consisting of: between about 5 millimeters to about 10 millimeters, between about 7.5 millimeters to about 12.5 millimeters; between about 10 millimeters to about 15 millimeters; between about 12.5 millimeters to about 17.5 millimeters; between about 15 millimeters to about 20 millimeters; between about 17.5 millimeters to about 22.5 millimeters; between about 20 millimeters to about 25 millimeters; between about 22.5 millimeters to about 27.5 millimeters; and between about 25 millimeters to about 30 millimeters.

As to particular embodiments, the secured pick holder height (62) can be lesser than a string height (63) (as shown in the example of FIG. 1B), which is the height of the strings (64) of a stringed instrument (3). The string height (63) can be measured from the strings (64) to the directly adjacent stringed instrument body surface (65) disposed beneath the strings (64). As an illustrative example, the secured pick holder height (62) can be about 12 millimeters, which can be less than the string height (63) of strings (64) coupled to a stringed instrument body surface (65).

As to particular embodiments, a method of producing the inventive pick holder (1) can including providing a body (5) having a body upper face (15), disposing a closed-end elongate aperture element (22) in the body (5) communicating with the body upper face (15), and affixing a securement element (47) to the body (5) opposite the body upper face (15). As to particular embodiments, the method of producing the inventive pick holder (1) can further include configuring the closed-end elongate aperture element (22) as a closed-end arcuate aperture element (41), which can releasably retain a pick (4). As to particular embodiments, the method of producing the inventive pick holder (1) can further include configuring the securement element (47) as a suction cup (48) and contouring a suction cup periphery (52) bounding the suction cup (48) to extend in generally adjacent parallel relation to a body upper face periphery (16) bounding the body upper face (15). As to particular embodiments, the method of producing the inventive pick holder (1) can further include contouring a body upper face periphery portion (19) and a suction cup periphery portion (55) to extend in generally adjacent parallel relation to a stringed instrument body periphery portion (20) or a pickguard periphery portion (21) (as shown in the example of FIG. 1).

As to particular embodiments, the method of producing the inventive pick holder (1) can further include disposing a pair of opposed aperture element sides (32)(33) at an aperture element width (26) of between about 0.1 millimeters to about 1.5 millimeters at the body upper face (15). As to particular embodiments, the method of producing the inventive pick holder (1) can further include tapering the pair of opposed aperture element sides (32)(33) inwardly approaching a closed end (38) of the closed-end arcuate aperture element (41).

As to particular embodiments, the method of producing the inventive pick holder (1) can further include configuring the inventive pick holder (1) to have a secured pick holder height (62) of between about 5 millimeters to about 15 millimeters when secured to a support surface (2).

As to particular embodiments, elements of the inventive pick holder (1) can be entirely formed of the same material, or alternatively, various portions of the inventive pick holder (1) can be formed from different materials. The inventive pick holder (1) can be produced from any of a wide variety of materials, including substantially inflexible materials, resiliently flexible materials, resiliently deformable materials, or the like, or combinations thereof. By way of non-limiting example, the material can include or consist of: rubber, rubber-like material, plastic, plastic-like material, acrylic, polyamide, polyester, polypropylene, polyvinyl chloride-based materials, silicone-based materials, or the like, or combinations thereof.

As to particular embodiments, the inventive pick holder (1) or elements of the inventive pick holder (1) can be produced from any of a wide variety of processes depending upon the application, such as press molding, injection molding, fabrication, machining, printing, three-dimensional printing, or the like, or combinations thereof, as one piece or assembled from a plurality of pieces into an embodiment of the inventive pick holder (1) or provided as a plurality of pieces for assembly into an embodiment of the inventive pick holder (1).

As to particular embodiments, a method of using the inventive pick holder (1) can include obtaining an inventive pick holder (1) including a body (5) having a body upper face (15), a closed-end elongate aperture element (22) disposed in the body (5) communicating with the body upper face (15), and a securement element (47) affixed to the body (5) opposite the body upper face (15); and removably securing the securement element (47) to a support surface (2), for example a stringed instrument body surface (65). As to particular embodiments, the closed-end elongate aperture element (22) can be a closed-end arcuate aperture element (41), which can releasably retain a pick (4). As to particular embodiments, the securement element (47) can be a suction cup (48) having a suction cup periphery (52) bounding the suction cup (48) which can be contoured to extend in generally adjacent parallel relation to a body upper face periphery (16) bounding the body upper face (15), the method of using the inventive pick holder (1) further including securing the suction cup (48) to a support surface (2) to position the suction cup periphery (52) and the body upper face periphery (16) in generally adjacent parallel relation to a stringed instrument body periphery portion (20) or a pickguard periphery portion (21).

As to particular embodiments, the inventive pick holder (1) can be removably coupled to a stringed instrument body surface (65) by removably securing the suction cup (48) with the stringed instrument body surface (65). For removable securement, the suction cup (48) can be positioned on the stringed instrument body surface (65) with the suction cup concave surface (50) disposed toward the stringed instrument body surface (65) and the suction cup convex surface (49) disposed away from the stringed instrument body surface (65). The suction cup convex surface (49) can be compressed toward the stringed instrument body surface (65) by applying pressure (as shown by the arrow in FIG. 10B) to the suction cup (48), the pressure sufficient to substantially flatten the suction cup concave surface (50) and expel gas from between the suction cup concave surface (50) and the stringed instrument body surface (65), the suction cup periphery (52) thereby forming a seal with the stringed instrument body surface (65) to removably securing the suction cup (48) to the stringed instrument body surface (65) and removably coupling the inventive pick holder (1) with the stringed instrument (3).

The method of using the inventive pick holder (1) can further include inserting a thin planar object (36), such as a pick (4), into the closed-end arcuate aperture element (41). As to particular embodiments, the closed-end arcuate aperture element (41) can be configured to releasably retain a tip portion (39) of the pick (4), positioning the broad portion (40) of the pick (4) for grasping.

As to particular embodiments, a user can grasp the broad portion (40) of the pick (4) to remove the pick (4) from securement with the inventive pick holder (1). Subsequently, a user can use the pick (4) to play the stringed instrument (3). As to particular embodiments, a portion of the hand of the user can be free from impediment by the inventive pick holder (1) in a secured condition (60) when playing the stringed instrument (3), as the secured pick holder height (62) can be lesser than the string height (63). As such, a portion of a hand strumming the strings (64) can avoid the inventive pick holder (1) in the secured condition (60) while strumming the strings (64).

As can be easily understood from the foregoing, the basic concepts of the present invention may be embodied in a variety of ways. The invention involves numerous and varied embodiments of a pick holder and methods for making and using such pick holders including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "pick holder" should be understood to encompass disclosure of the act of "pick holding"—whether explicitly discussed or not—and, conversely, were there effectively disclosure of the act of "pick holding", such a disclosure should be understood to encompass disclosure of a "pick holder" and even a "means for pick holding." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the pick holders herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A pick holder comprising:

a body having a body upper face;

a closed-end aperture element disposed in said body and communicating with said body upper face, said closed-end aperture element arcuate over a closed-end aperture element length disposed between closed-end aperture element first and second ends; and a securement element affixed to said body opposite said body upper face.

2. The pick holder of claim 1, further comprising a body upper face periphery bounding said body upper face, said body upper face periphery including a body upper face periphery portion contoured to extend in generally adjacent parallel relation to a stringed instrument body periphery portion.

3. The pick holder of claim 1, further comprising a body upper face periphery bounding said body upper face, said body upper face periphery including a body upper face periphery portion contoured to extend in generally adjacent parallel relation to a pickguard periphery portion.

4. The pick holder of claim 1, wherein said closed-end aperture element includes a pair of opposed closed-end aperture element sides disposed between a pair of opposed closed-end aperture element ends.

5. The pick holder of claim 4, wherein said closed-end aperture element has a configuration which releasably retains a pick.

6. The pick holder of claim 5, wherein said closed-end aperture element has a closed-end aperture element width between said pair of opposed closed-end aperture element sides of between about 0.1 millimeters to about 1.5 millimeters at said body upper face.

7. The pick holder of claim 5, wherein said pair of opposed closed-end aperture element sides taper inwardly approaching a closed end of said closed-end aperture element.

8. The pick holder of claim 5, further comprising a body upper face periphery bounding said body upper face, wherein said securement element comprises a suction cup having a suction cup periphery bounding said suction cup, said body upper face periphery and said suction cup periphery contoured to extend in generally adjacent parallel relation.

9. The pick holder of claim 1, wherein said pick holder secured to a support surface by said securement element has a secured pick holder height of between about 5 millimeters to about 15 millimeters.

10. A pick holder comprising:

a body having a body upper face;

a body upper face periphery bounding said body upper face;

a closed-end aperture element disposed in said body and communicating with said body upper face;

a suction cup affixed to said body opposite said body upper face;

a suction cup periphery bounding said suction cup; and said body upper face periphery and said suction cup periphery contoured to extend in generally adjacent parallel relation.

11. The pick holder of claim 10, wherein said body upper face periphery includes a body upper face periphery portion contoured to extend in generally adjacent parallel relation to a stringed instrument body periphery portion.

12. The pick holder of claim 10, wherein said body upper face periphery includes a body upper face periphery portion contoured to extend in generally adjacent parallel relation to a pickguard periphery portion.

13. The pick holder of claim 10, wherein said closed-end aperture element is arcuate over a closed-end aperture element length disposed between closed-end aperture element first and second ends.

14. The pick holder of claim 13, wherein said closed-end aperture element has a configuration which releasably retains a pick.

15. The pick holder of claim 14, wherein said closed-end aperture element includes a pair of opposed closed-end aperture element sides disposed between a pair of opposed closed-end aperture element ends.

16. The pick holder of claim 15, wherein said closed-end aperture element has a closed-end aperture element width between said pair of opposed closed-end aperture element sides of between about 0.1 millimeter to about 1.5 millimeters.

17. The pick holder of claim 16, wherein said pair of opposed closed-end aperture element sides taper inwardly approaching a closed end of said closed-end aperture element.

18. The pick holder of claim 17, wherein said pick holder secured to a support surface by said suction cup has a secured pick holder height of between about 5 millimeters to about 15 millimeters.

19. A method of producing a pick holder comprising:

providing a body having a body upper face;

disposing a closed-end aperture element in said body communicating with said body upper face, said closed-end aperture element arcuate over a closed-end aperture element length disposed between closed-end aperture element first and second ends; and affixing a securement element to said body opposite said body upper face.

20. The method of claim 19, further comprising contouring a body upper face periphery portion bounding said body upper face to extend in generally adjacent parallel relation to a stringed instrument body periphery portion.

* * * * *